US009908729B2

(12) United States Patent
Edmonds et al.

(10) Patent No.: US 9,908,729 B2
(45) Date of Patent: Mar. 6, 2018

(54) PAPER DISPENSER

(71) Applicant: Kohler Co., Kohler, WI (US)

(72) Inventors: Cary D. Edmonds, Plymouth, WI (US); Nicole A. Sorenson, Sheboygan, WI (US)

(73) Assignee: KOHLER CO., Kohler, WI (US)

( * ) Notice: Subject to any disclaimer, the term of this patent is extended or adjusted under 35 U.S.C. 154(b) by 64 days.

(21) Appl. No.: 14/333,399

(22) Filed: Jul. 16, 2014

(65) Prior Publication Data

US 2014/0326823 A1 Nov. 6, 2014

Related U.S. Application Data

(63) Continuation of application No. 13/028,938, filed on Feb. 16, 2011, now Pat. No. 8,789,788.

(51) Int. Cl.

| | |
|---|---|
| ***B65H 16/06*** | (2006.01) |
| ***A47K 10/00*** | (2006.01) |
| ***A47K 10/40*** | (2006.01) |
| ***B65H 16/00*** | (2006.01) |

(52) U.S. Cl.

CPC ..... *B65H 16/06* (2013.01); *A47K 10/00* (2013.01); *A47K 10/405* (2013.01); *B65H 16/005* (2013.01); *A47K 2201/02* (2013.01)

(58) Field of Classification Search

USPC ..... 242/591, 598, 598.1, 598.2, 599, 599.3, 242/129.6

See application file for complete search history.

(56) References Cited

U.S. PATENT DOCUMENTS

| | | | | |
|---|---|---|---|---|
| 497,005 A | | 5/1893 | Jerome | |
| 810,606 A | | 1/1906 | Ball | |
| 873,188 A | | 12/1907 | Thumann | |
| 1,069,757 A | * | 8/1913 | Bens et al. | A47K 10/38 242/598.2 |
| 1,182,523 A | | 5/1916 | Benson | |

(Continued)

FOREIGN PATENT DOCUMENTS

DE 20308 30 0 8/2003

OTHER PUBLICATIONS

International Search Report and Written Opinion for Application No. PCT/US2012/024611, dated Sep. 13, 2012, 9 pages.

*Primary Examiner* — Michael Gallion
(74) *Attorney, Agent, or Firm* — Foley & Lardner LLP

(57) ABSTRACT

A rolled paper dispenser including a first arm having a base portion and an end portion; a first mounting bracket attachable to a wall and disposed in a cavity of the base portion of the first arm; first and second bushing members that are rotatable relative to one another, such that the end portion of the first arm and the first bushing member are selectively rotatable relative to the second bushing member and the first mounting bracket; a second arm including a second cavity; a second mounting bracket attachable to the wall and disposed entirely in the second cavity; and an elongated member configured to receive the rolled paper product, the elongated member detachably coupled to the end portion of the first arm by a fastener extending through the elongated member, such that the elongated member rotates with the end portion of the first arm relative to the second arm.

21 Claims, 11 Drawing Sheets

(56) References Cited

U.S. PATENT DOCUMENTS 1,665,738 A * 4/1928 Hoegger ..... A47K 10/22 242/598.2
1,665,739 A * 4/1928 Hoegger ..... A47K 10/40 101/216
1,778,856 A * 10/1930 Hoegger ..... A47K 10/22 242/565
1,889,024 A 11/1932 Marsh
2,466,957 A 4/1949 Lewis
2,517,809 A 8/1950 Tarzian
3,022,957 A 2/1962 Blunt et al.
3,138,340 A 6/1964 Caravella
3,157,370 A 11/1964 Govatsos et al.
3,295,777 A 1/1967 Carroll
3,586,252 A 6/1971 Sutton
D259,906 S 7/1981 Fleischmann et al.
4,381,083 A 4/1983 Tsunetsugu
4,416,425 A 11/1983 Kish
4,741,486 A * 5/1988 Ancona ..... A47K 10/3836 242/597.4
4,775,109 A 10/1988 Tegg
4,824,038 A * 4/1989 Chandler ..... A47K 10/3836 242/598.2
4,836,462 A 6/1989 Bruss
4,871,123 A 10/1989 Lee
D317,386 S 6/1991 McKeone
5,149,003 A 9/1992 Tharp
5,222,678 A 6/1993 Carrington
5,450,981 A 9/1995 Fields
5,669,576 A * 9/1997 Moody ..... A47K 10/38 242/560.3
5,718,396 A * 2/1998 Maresca ..... A47K 10/405 242/598.2
5,765,775 A 6/1998 Keserica
5,782,428 A 7/1998 Chabot
5,868,344 A * 2/1999 Melnick ..... A47K 10/3836 242/591
5,871,170 A 2/1999 Morales et al.
5,913,491 A 6/1999 Bulla
6,007,019 A 12/1999 Lynch
6,199,791 B1 * 3/2001 Conran ..... A47K 10/38 242/422.4
D450,962 S 11/2001 Hundley
6,328,253 B1 * 12/2001 Paul ..... A47K 10/40 242/596.3
D521,288 S 5/2006 Barry
D534,023 S 12/2006 Berberet et al.
7,290,733 B2 * 11/2007 Kamenstein ..... B65H 75/245 242/598.2
7,367,524 B2 5/2008 Burnett
D573,821 S 7/2008 Rubin et al.
7,762,493 B2 7/2010 Berberet et al.
2002/0020780 A1 * 2/2002 Otsuji ..... A47K 10/40 242/598.2
2006/0261211 A1 * 11/2006 Hass ..... A47K 10/405 242/598.1
2007/0158491 A1 7/2007 Moore
2007/0267534 A1 * 11/2007 Burnett ..... A47K 10/405 242/598.2
2009/0242713 A1 10/2009 Lowe et al.

* cited by examiner

PAPER DISPENSER

CROSS-REFERENCE TO RELATED PATENT APPLICATIONS

This application is a Continuation of U.S. patent application Ser. No. 13/028,938, which was filed on Feb. 16, 2011, the entire disclosure of which is incorporated herein by reference.

BACKGROUND

The present disclosure relates generally to the field of paper dispensers. More particularly, the present disclosure relates to dispensers for rolled paper products, such as toilet paper, paper towels, and other rolled paper products.

Conventional dispensers for rolled paper products, such as toilet paper or paper towels, typically have a sprung bar extending and compressed between two members extending from a mounting surface. A roll of product is placed onto the sprung bar and held in place to allow product to be dispensed. To remove an empty roll or receive a new roll or product, the sprung bar is compressed to a length less than the distance between the two members, such that the sprung bar may be removed from the two members.

It would be advantageous to provide an improved dispenser that may allow rolls of paper products to be changed in an easier manner.

SUMMARY

According to an exemplary embodiment a dispenser for a rolled paper product is provided. The dispenser includes a first arm, a first mounting bracket, a bushing assembly, a second arm, a second mounting bracket, and an elongated member configured to receive the rolled paper product. The first arm includes a base portion and an end portion. The first mounting bracket is disposed in a cavity of the base portion of the first arm and is configured to be coupled to a wall. The bushing assembly includes first and second members that are rotatable relative to one another, such that the end portion of the first arm and the first member are selectively rotatable relative to the second member and the first mounting bracket. The second arm includes a second cavity, and the second mounting bracket is disposed entirely in the second cavity. The second mounting bracket is configured to rigidly couple the second arm to the wall. The elongated member is detachably coupled to the end portion of the first arm by a fastener extending through the elongated member, such that the elongated member rotates with the end portion of the first arm relative to the second arm.

According to an exemplary embodiment a paper dispenser for a rolled paper product is provided. The dispenser includes a first arm including an aperture, a second arm, and an elongated holder assembly coupled to the first arm and configured to retain the rolled paper product. The holder assembly includes a hollow member having first and second ends. The holder assembly further includes a fastener disposed in the hollow member that engages the aperture of the first arm to couple the holder assembly to the first arm. When the holder assembly is coupled to the first arm, the first arm is configured to rotate the holder assembly relative to the second arm.

According to an exemplary embodiment a dispenser for a rolled paper product is provided. The dispenser includes a first arm assembly, a second arm assembly, and a holder assembly. The first arm assembly includes a first base portion, a first end portion, a bushing, and a first mounting bracket disposed in a cavity of the first base portion. The first mounting bracket is configured to be fixedly coupled to a wall. The bushing allows selective rotation of the first end portion relative to the first mounting bracket. The second arm assembly includes a second base portion, a second end portion, and a second mounting bracket disposed in a cavity of the second base portion. The second mounting bracket is configured to rigidly couple the second arm assembly to the wall. The holder assembly includes a first member configured to receive the rolled paper product and a second member disposed within the first member, wherein a portion of the second member extends beyond an end of the first member to selectively couple the portion of the second member to the first end portion, such that the holder assembly rotates with the first end portion relative to the second arm assembly.

According to an exemplary embodiment, a dispenser for a rolled paper product includes a first arm comprising an elongate member configured to receive a roll of product and a first mounting bracket configured to rotatingly couple the first arm to a mounting surface. The dispenser also includes a second arm and a second mounting bracket configured to rigidly couple the second arm to the mounting surface. The first arm is configured to cover the first mounting bracket from view.

According to another exemplary embodiment, a paper dispenser includes a first arm comprising a base portion and an elongate member comprising a first end rigidly coupled to the first arm and a second end comprising an engaging surface. The dispenser also includes a second arm comprising a base portion and an end portion comprising an extension. The first arm is configured to rotate in a plane generally parallel to a mounting surface such that the engaging surface of the elongate member engages the extension of the second arm, and wherein the engaging surface and post are configured to prevent translational movement between the extension member and second arm.

According to another exemplary embodiment, a paper dispenser includes a first arm coupled to an elongate member and a first mounting bracket configured to rotatingly couple the first arm to a mounting surface. The paper dispenser also includes a second arm and a second mounting bracket configured to rigidly couple the second arm to the mounting surface. The first arm and first mounting bracket are configured to limit rotation of the first arm to a predetermined angular range.

DETAILED DESCRIPTION

Figure 1A:
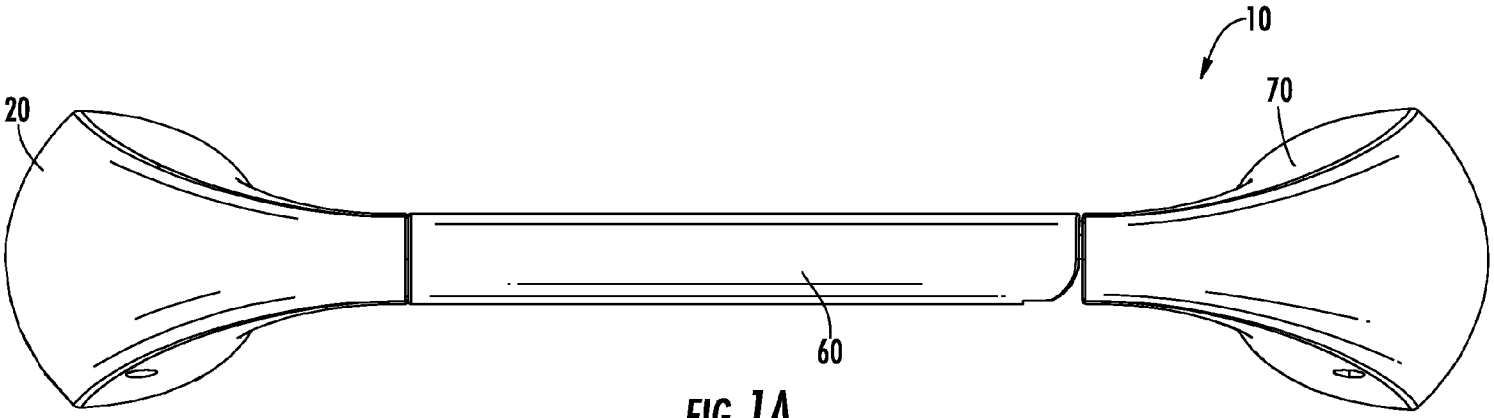
FIG. 1A is a front view of a paper dispenser in a closed position according to an exemplary embodiment.
Figure 1B:
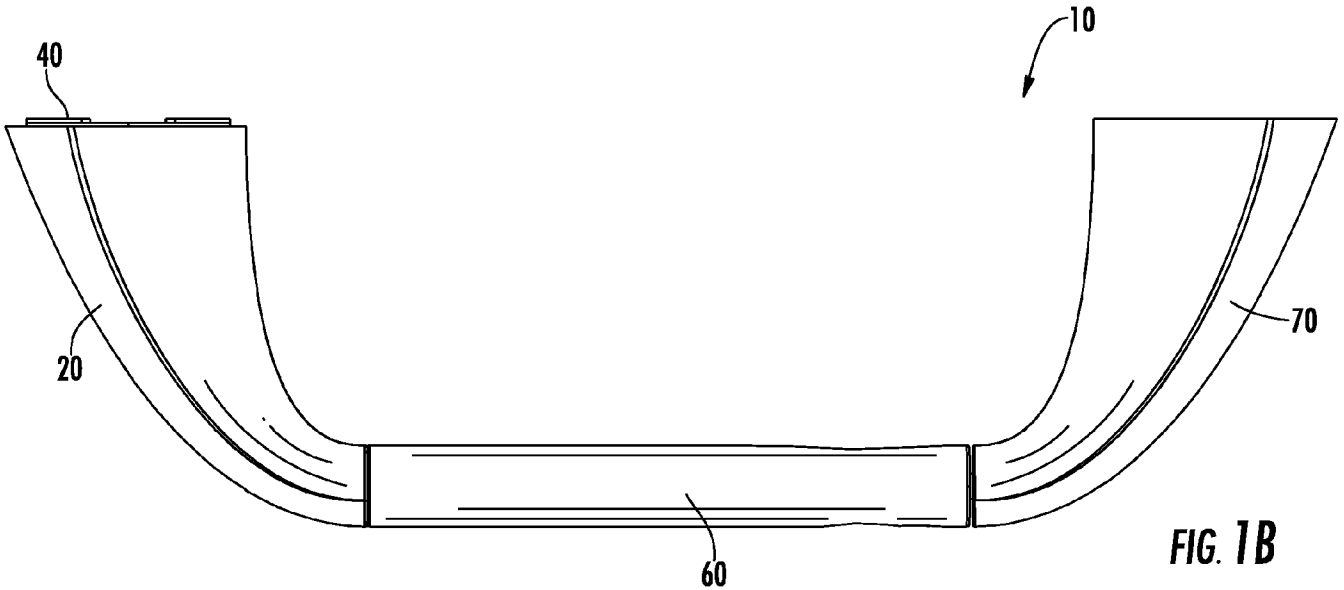
FIG. 1B is a top view of a paper dispenser in a closed position according to an exemplary embodiment.
Figure 1C:
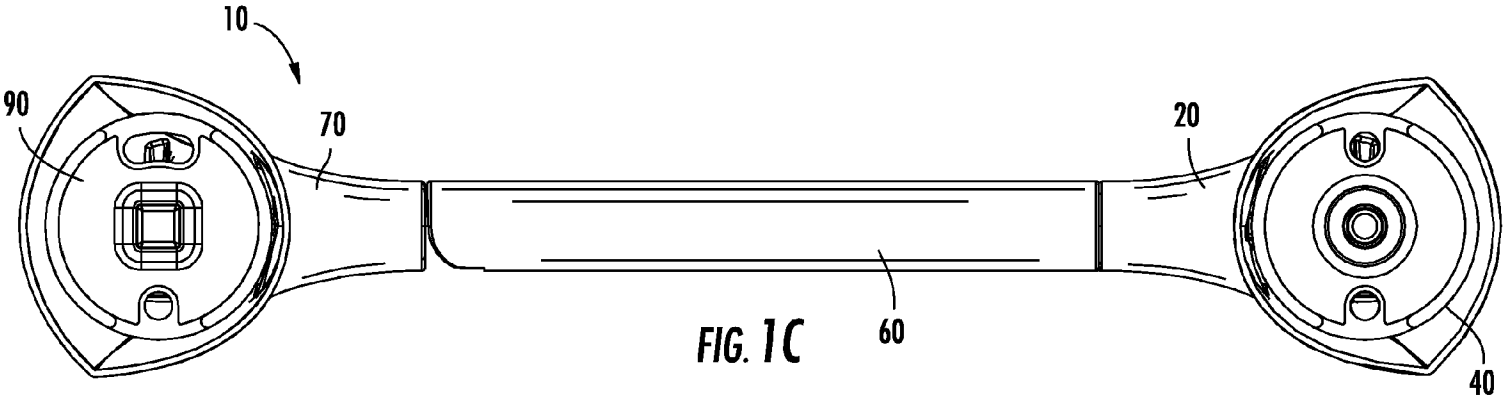
FIG. 1C is a rear view of a paper dispenser in a closed position according to an exemplary embodiment.
Figure 1D:
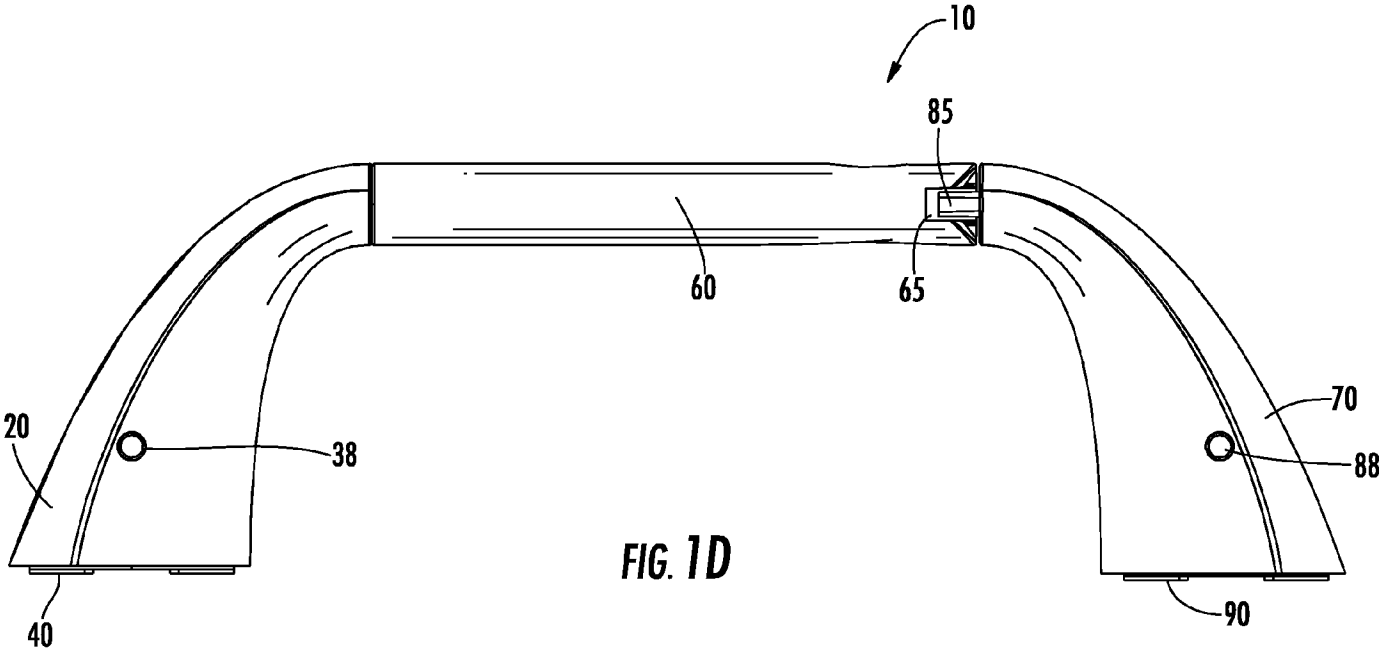
FIG. 1D is a bottom view of a paper dispenser in a closed position according to an exemplary embodiment.
Figure 2:
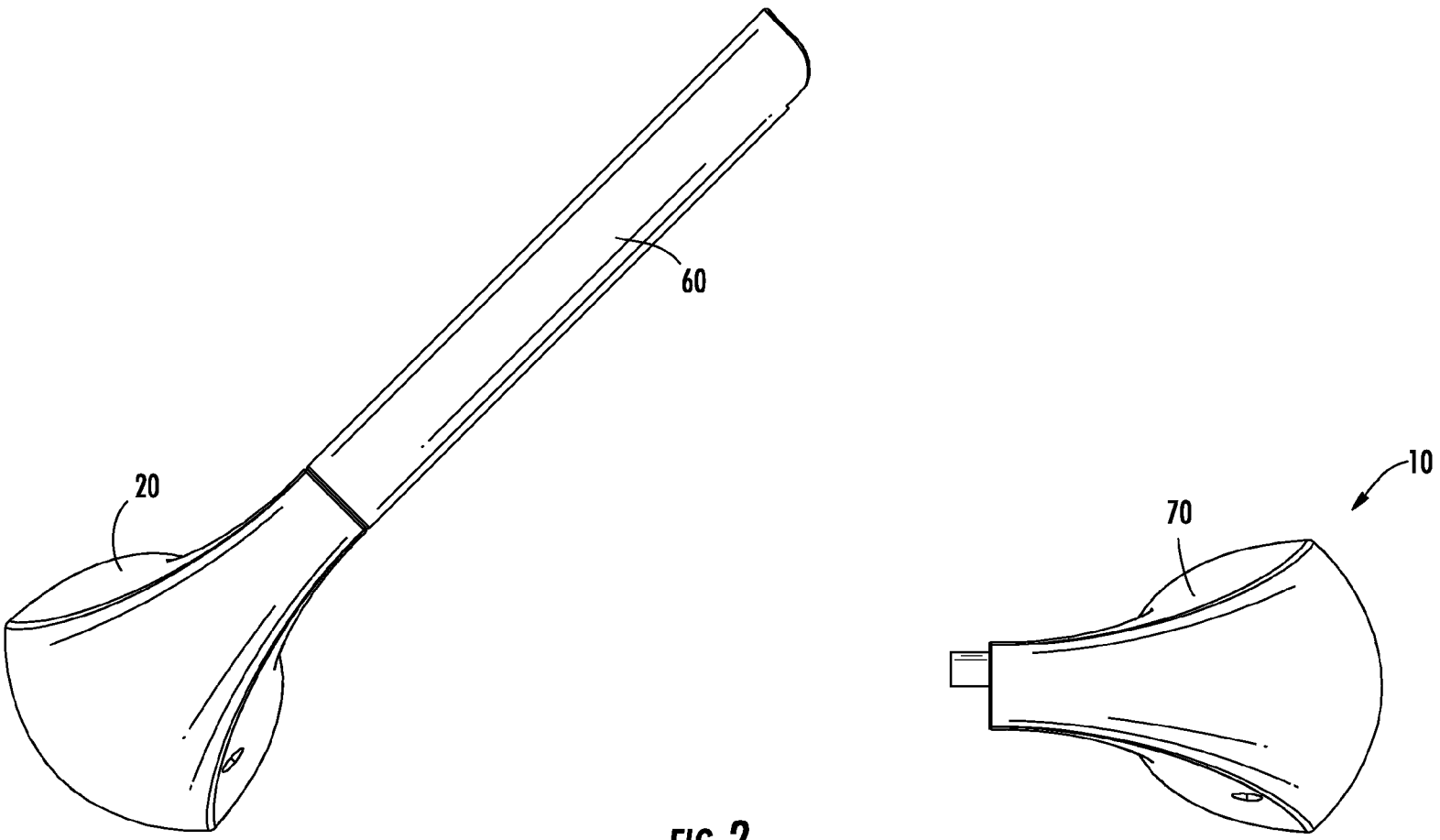
FIG. 2 is a front view of a paper dispenser in an open position according to an exemplary embodiment.

According to an exemplary embodiment, a dispenser for rolled paper product includes a first arm and a second arm, with the first arm having an elongate member configured to receive a roll of paper product. A first mounting bracket is configured to rotatingly couple the first arm to a mounting surface. The first arm is configured to cover the first mounting bracket from view. A second mounting bracket is configured to rigidly couple the second arm to the mounting surface.

According to an exemplary embodiment, a paper dispenser includes a first arm, elongate member, and second arm. The first arm includes a base portion. The elongate member includes a first end that is rigidly coupled to the first arm and a second end having an engaging surface. The second arm includes a base portion and an end portion having an extension. The first arm is configured to rotate in a plane generally parallel to the mounting surface such that the engaging surface of the elongate member engages the extension of the second arm. The engaging surface and the post are configured to prevent translational movement between the extension member and the second arm.

According to an exemplary embodiment, a paper dispenser includes a first arm, a first mounting bracket, a second arm, a second mounting bracket, and an elongate member. The first arm is coupled to the elongate member. The first mounting bracket is configured to rotatingly couple the first arm to a mounting surface. The first arm and the first mounting bracket are configured to limit rotation of the first arm to a predetermined angular range.

Referring to FIGS. 1A-1D and 2, according to an exemplary embodiment, a paper dispenser 10 generally includes a first arm 20, an extension member 60 rigidly coupled to the first arm, and a second arm 70. The first and second arms 20, 70 are configured to be coupled to and extend from a generally mounting surface, such as a vertical wall, cabinet base, or door. In a closed position (see FIG. 1A), the paper dispenser 10 is configured to hold and retain a roll of paper product. More particularly, the extension member 60 is arranged between the first and second arms 20, 70 and is releasably engaged with the second arm. In an open position (see FIG. 2), the paper dispenser 10 is configured to receive a new roll of paper product or have removed an empty roll. More particularly, in the open position, the first arm 20 is rotated about a generally perpendicular axis to the surface, such that the extension member 60 is not engaged with the second arm 70.

Figure 3A:
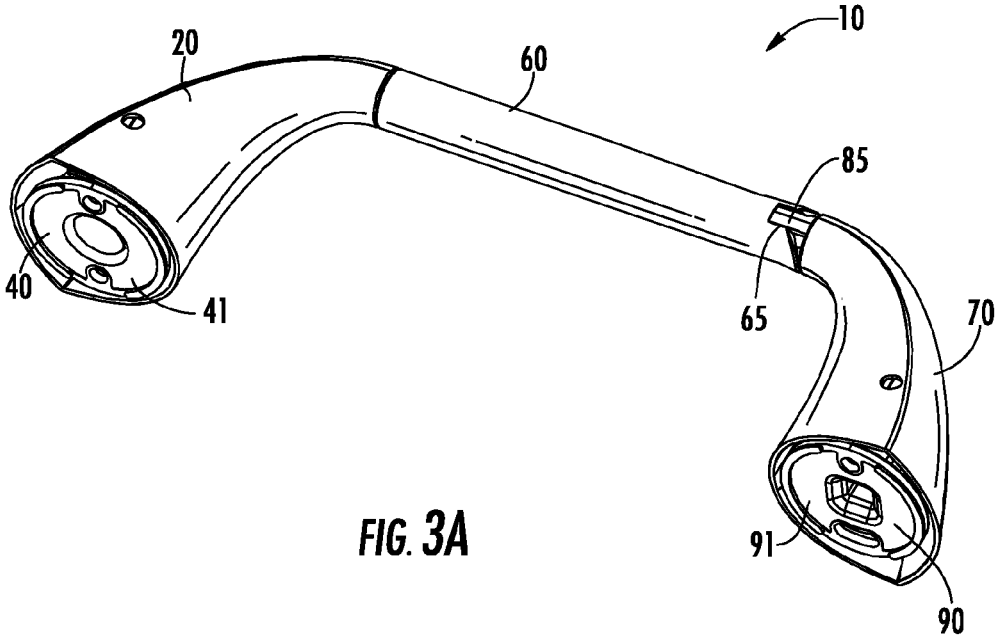
FIG. 3A is a perspective
Figure 3B:
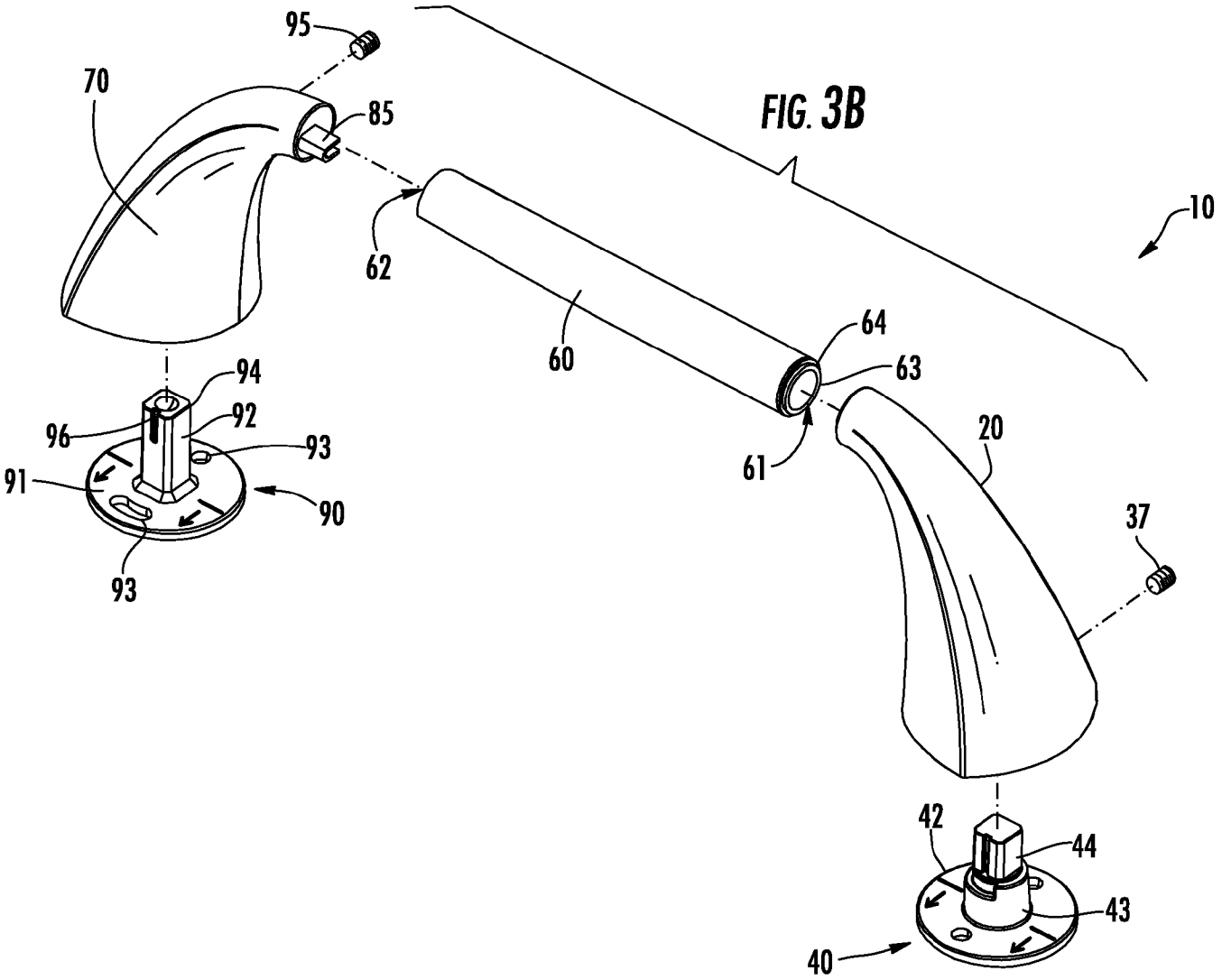
FIG. 3B is an exploded perspective view of a paper dispenser according to an exemplary embodiment.
Figure 4:
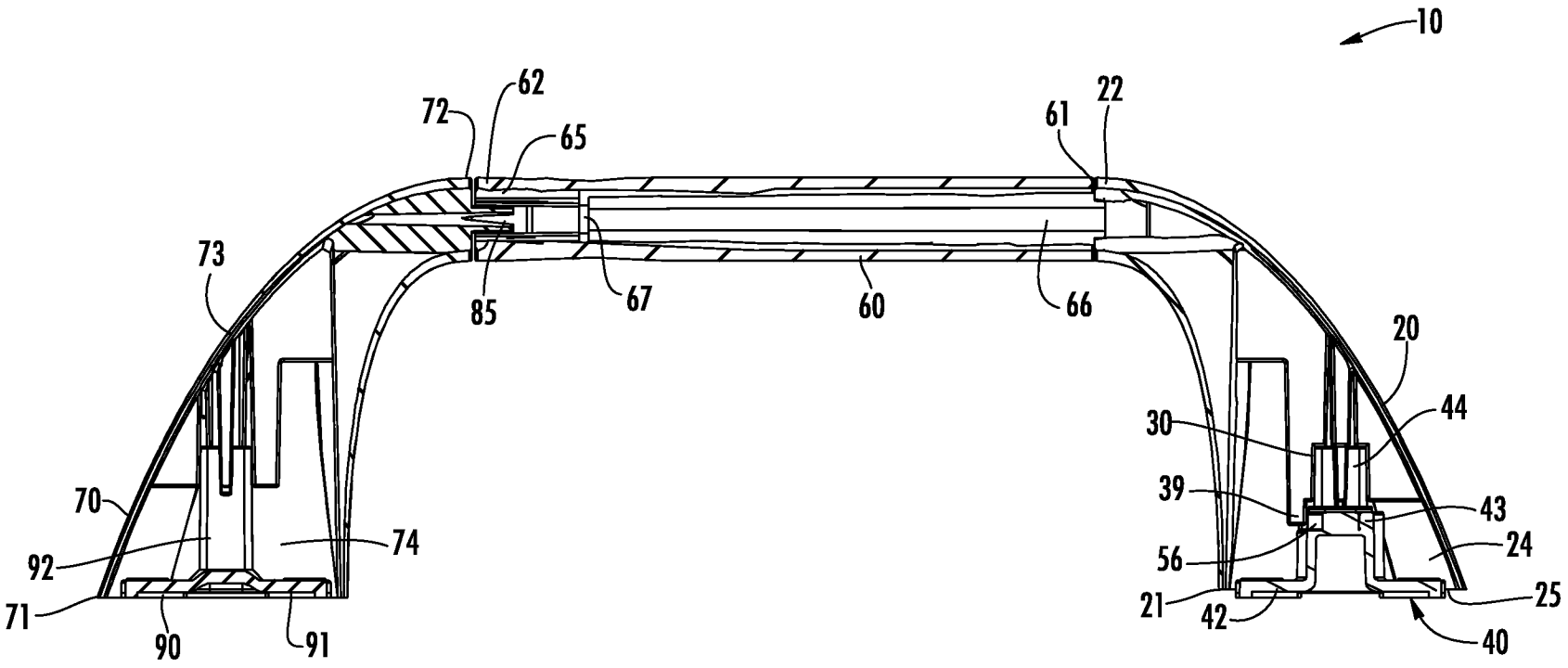
FIG. 4 is a cross-sectional view of a paper dispenser according to an exemplary embodiment.

Now referring to FIGS. 3A, 3B, and 4, according to an exemplary embodiment, the paper dispenser 10 includes a first arm 20 and a corresponding rotating mounting bracket 40, a second arm 70 and a corresponding stationary mounting bracket 90, and an extension member 60 extending from the first arm 20. As discussed below, the rotating and stationary mounting brackets 40, 90 are configured to couple the first and second arms 20, 70, respectively, to a mounting surface. More particularly, the rotating mounting bracket 40 provides a rotating coupling for the first arm 20 to mount to the mounting surface, and the stationary mounting bracket 90 provides a stationary coupling for the second arm 70 to mount to the mounting surface.

According to an exemplary embodiment, the first arm 20, extension member 60, and second arm 70 are matching cast brass pieces with a chrome finish. According to other exemplary embodiments, the first arm 20, extension member 60, and second arm 70 are not matching, are made from different materials (e.g., aluminum, zinc, alloys, composites, plastic, etc.), are manufactured according to different methods (e.g., machining, molding, etc.), and/or may have different finishes (e.g., bronze, brushed, satin, painted, etc.).

According to an exemplary embodiment, the rotating and stationary mounting brackets 40, 90 are cast aluminum. According to other exemplary embodiments, the rotating and stationary mounting brackets 40, 90 may be made from different materials (e.g., brass, zinc, allows, composites, plastic, etc.) and/or may be manufactured according to different methods (e.g., machining, molding, etc.). Further, the rotating and stationary mounting brackets 40, 90 may include other components made from other materials.

Figure 5A:
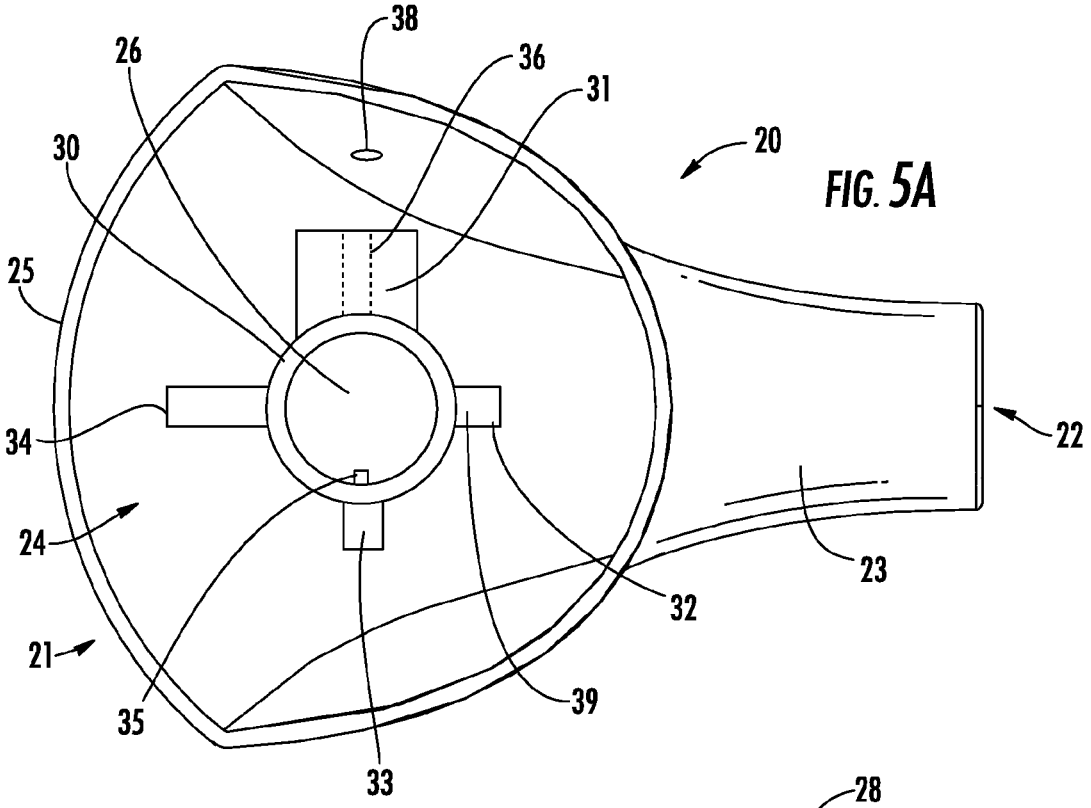
FIG. 5A is a rear view of a first arm of a paper dispenser according to an exemplary embodiment.
Figure 5B:
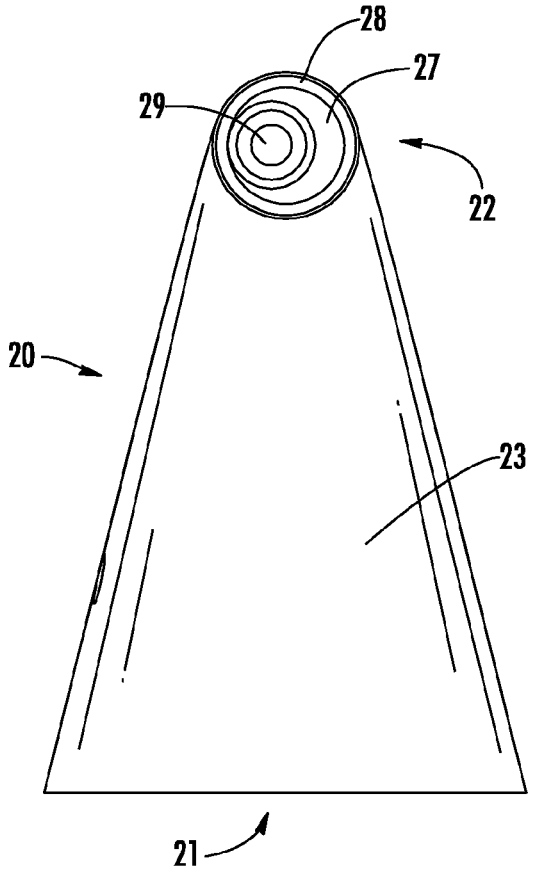
FIG. 5B is a side view of the first arm shown in FIG. 5A according to an exemplary embodiment.

Now referring to FIG. 5A-5B, according to an exemplary embodiment, the first arm 20 generally includes a base portion 21, an end portion 22, and a body portion 23 extending between the base portion 21 and end portion 22. The base portion 21 includes a cavity 24 generally defined by a base peripheral edge 25 and an interior surface of the body portion 23. The cavity 24 includes a receptacle 26 integrally or separately formed from the first arm 20. As discussed in further detail below, the first arm 20 is configured to couple to the rotating mounting bracket 40 by way of the receptacle 26 receiving a rotating post or extension 44 of the rotating mounting bracket 40. Accordingly, various features of the first arm 20 and receptacle 26 are discussed in conjunction with the rotating mounting bracket 40 below.

According to an exemplary embodiment, similar to the base portion 21, the end portion 22 includes a cavity 27, which may or may not be continuous with cavity 24 of the base portion 21. The cavity 27 is defined by an interior surface of the body portion 23 and a peripheral edge 28. A fastening aperture 29 is disposed within the cavity 27 and is coupled to or integrally formed with the first arm 20. As discussed in further detail below, the first arm 20 is configured to rigidly couple to the extension member 60 at the end portion 22. Various features of the first arm 20 and the end portion 22 are discussed in conjunction with the extension member 60.

Figure 6A:
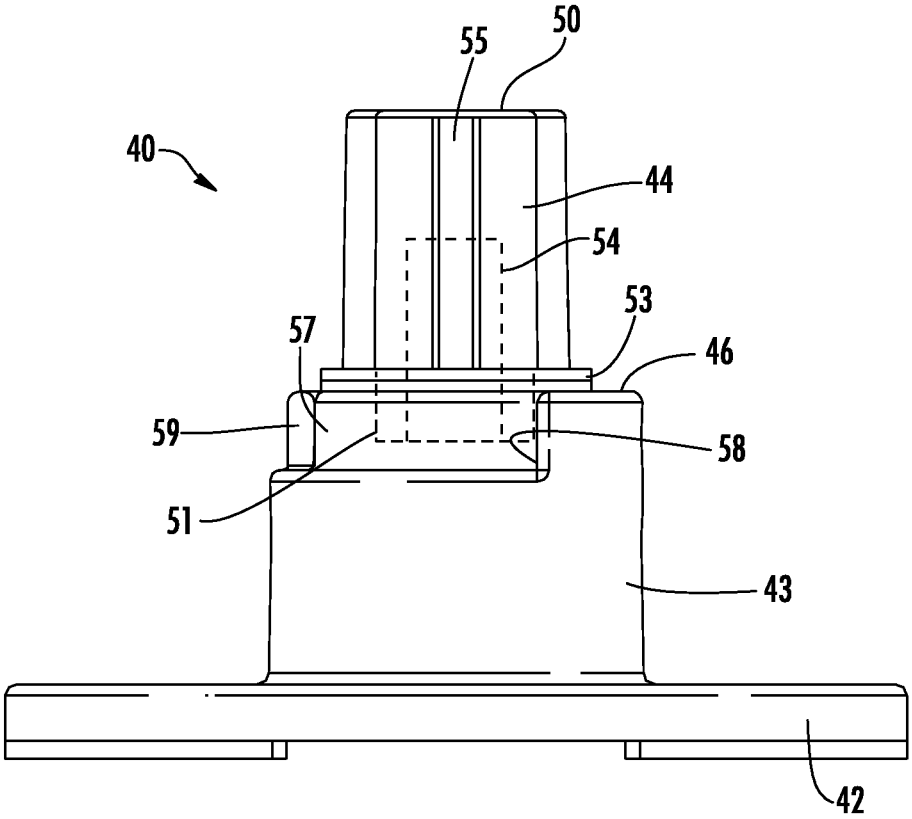
FIG. 6A is a perspective view of a rotating bracket of a paper dispenser according to an exemplary embodiment.
Figure 6B:
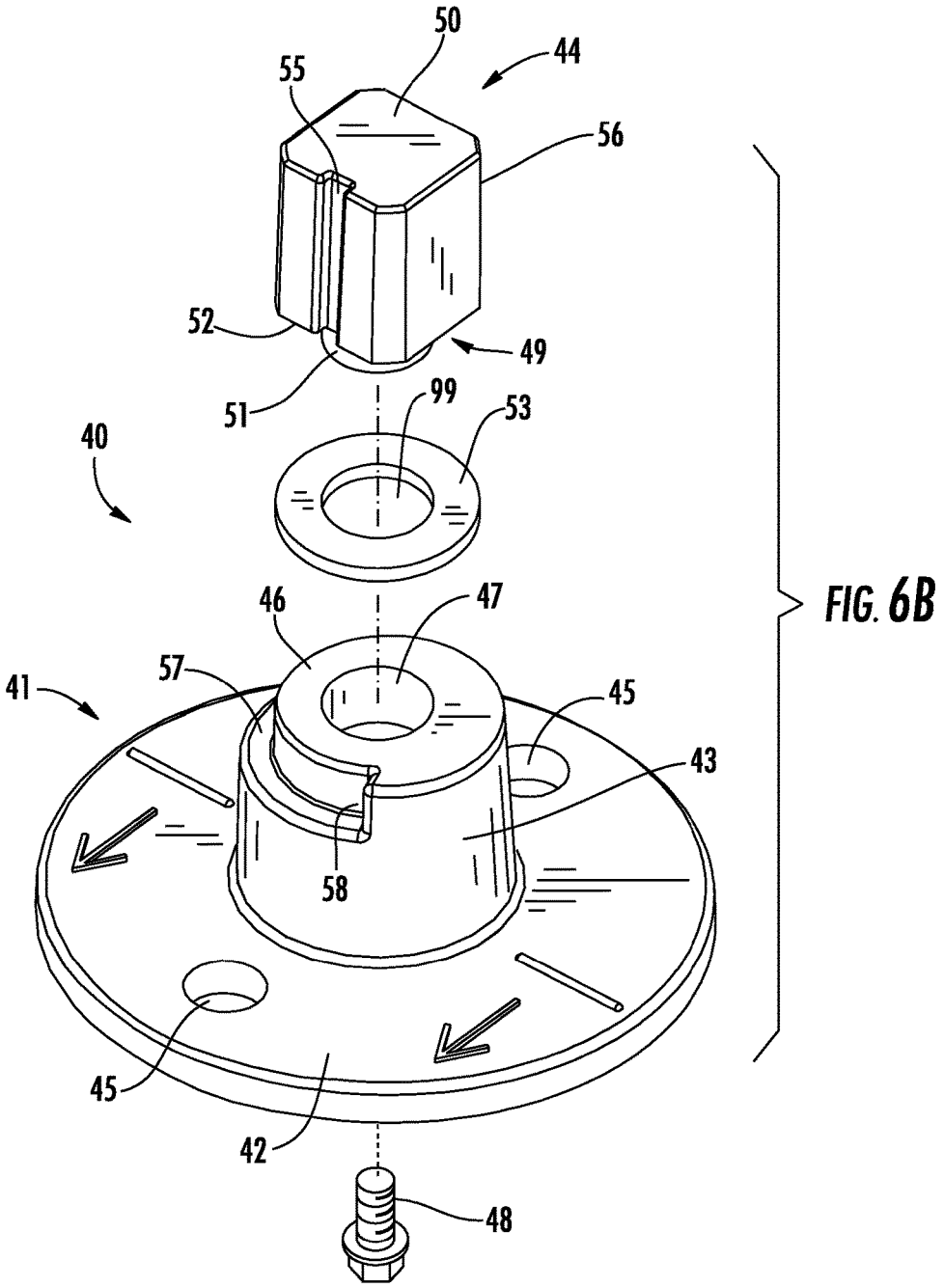
FIG. 6B is an exploded perspective view of the rotating bracket shown in FIG. 6A according to an exemplary embodiment.

Now referring to FIG. 6A-6B, according to an exemplary embodiment, the rotating mounting bracket 40 generally includes a base 41 configured to mount to the mounting surface and a rotating post 44 configured to rotate relative to the base 41. The base 41 includes a base flange 42 and a base post 43. The base flange 42 is configured to be coupled to the mounting surface and includes one or more apertures 45 configured to receive fasteners (e.g., screws, bolts, clips, pins, etc.) for coupling the base flange 42 to the mounting surface.

According to an exemplary embodiment, the base post 43 is configured to provide a surface against which the rotating post 44 may rotate. The base post 43 is a generally hollow cylindrical or conical member. The base post 43 extends away from the base flange 42 from a concentric location at generally a perpendicular angle and terminates at a post flange 46 (e.g., a flat surface generally parallel with the base flange 42). An aperture 47 is concentrically located on the post flange 46 and is configured to receive a fastener 48 for coupling the rotating post 44 to the base post 43. The aperture 47 may also be configured to receive a portion of the rotating post 44.

According to an exemplary embodiment, the rotating post 44 is configured to be rotatingly coupled to the base post 43 of the rotating mounting bracket 40. The rotating post 44 is a generally elongate member (e.g., squared-off cylindrical, cylindrical, rectangular, conical, etc.) that terminates at first and second ends 49, 50. The first end 49 of the rotating post 44 is configured to be disposed proximate the post flange 46 of the base post 43. The first end 49 includes a shoulder portion 52 configured to abut the post flange 46 or a bushing 53 disposed therebetween. The first end 49 also includes an extension 51 configured to be disposed in the aperture 47 of the base post 43 to maintain concentric alignment of the base post 43 relative to the rotating post 44 (e.g., a cylindrical or partial-conical extension having tight tolerance to the aperture 47 of the base post 43). The first end 49 also includes an aperture 54 configured to receive and couple to the fastener 48, such as via threads. According to other exemplary embodiments, the rotating post 44 may be configured in other manners including, for example, providing no extension 51, with the rotating post 44 instead being held in alignment by the fastener 48 that is configured to abut the aperture 47 of the base post 43.

According to an exemplary embodiment, the rotating mounting bracket 40 includes a bushing 53. The bushing 53 is configured to provide one or more surfaces against which the post flange 46 of the base post 43 and/or the shoulder 52 of the rotating post 44 may slide. The bushing 53 includes a central aperture 99 for receiving the fastener 48 therethrough.

According to an exemplary embodiment, the base post 43, rotating post 44, fastener 48, and bushing 53 are collectively configured to control the torque required to rotate the rotating post 44 (i.e., and the first arm 20) relative to the base post 43 (i.e., and the mounting surface). A desired torque required to move the rotating post 44 may, for example, require a desired amount of force be applied to the first arm 20 and extension member 60 to move between open and close positions. The required input torque may, for example, be controlled by configuring the base post 43 and rotating post 44 (e.g., providing different surface finishes or surface areas to the post flange 46 and/or the shoulder 52, etc.), configuring the bushing 53 (e.g., material selection, surface finish on either side, thickness, etc.), and the compression between the post flange 46 of the base post 43 and the shoulder 52 of the rotating post 44 (e.g., tightening a threaded fastener 48 to a specified torque, specifying a distance between the post flange 46 of the base post 43 and the shoulder 52 of the rotating post 44, etc.). The fastener 48 may be held in position relative to the rotating post 44 to fix the compression and torque required for motion between the rotating post 44 and the base post 43 by, for example, using an adhesive, providing an abutting surface within the aperture 54, and/or providing tight tolerance between the aperture 54 and the fastener 48.

Referring now to FIGS. 4, 5A-5B, and 6A-6B, according to an exemplary embodiment, corresponding features of the receptacle 26 and rotating post 44 are configured to rigidly couple the first arm 20 to the rotating mounting bracket 40 and limit rotational movement of the first arm 20 relative to the mounting surface. Further, the first arm 20 is configured to generally cover the rotating mounting bracket 40 from view.

According to an exemplary embodiment, the first arm 20 is configured to rigidly couple to the rotating mounting bracket 40 through various complementary features of the first arm 20 and the rotating mounting bracket 40. For example, the receptacle 26 and rotating post 44 include, respectively, corresponding interior and exterior shapes, a tab and slot, and an aperture and mating surface for receiving a fastener.

According to an exemplary embodiment, the receptacle 26 and rotating post 44 are configured to allow the receptacle 26 to receive the rotating post 44. The receptacle 26 is generally defined by an exterior wall 30 having four supports 31, 32, 33, 34 extending between the wall 30 and the interior portion of the body 23 of the first arm 20. The receptacle 26 and rotating post 44 are shaped and sized in a complementary manner, such that the rotating post 44 may be disposed generally inside the receptacle 26 with relatively tight tolerance (e.g., generally cylindrical cross-sectional shapes and less than approximately 1 mm). The receptacle 26 and/or the rotating post 44 may also be tapered for easy assembly and/or alignment (e.g., the receptacle 26 being wider at its opening, and the rotating post 44 being narrower at its second end 50 compared to its first end 49). According to other exemplary embodiments, the receptacle 26 and rotating post 44 may be configured in other contemplated manners including, for example, by providing different shapes (e.g., round, polygonal, square, rectangular, conical or otherwise tapered, whether the same or different for the receptacle 26 and rotating post 44), by providing lesser or greater tolerance (e.g., approximately 0.2 mm, 0.5 mm, 2 mm, etc.), and/or by providing the receptacle 26 in different manners (e.g., no exterior wall and only separate surfaces, more or fewer supports, integral with or separate and coupled to the first arm 20).

According to an exemplary embodiment, the receptacle 26 includes a tab 35 that is complementary to a slot 55 of the rotating post 44 configured to receive the tab 35. The tab 35 and slot 55 may be configured to ensure proper alignment between the receptacle 26 and the rotating post 44 and/or to prevent relative rotation between the receptacle 26 and the rotating post 44. The receptacle 26, tab 35, rotating post 44, and slot 55 are sized according to each other such that the rotating post 44 may not be inserted into the receptacle 26 without the slot 55 also receiving the tab 35. The tab 35 and/or slot 55 may also be tapered for easy assembly and/or alignment (e.g., the slot 55 being wider at its opening, and the tab 35 being narrow toward the opening of the receptacle 26). According to other exemplary embodiments, the receptacle 26 and rotating post 44 may be configured in other manners to prevent misalignment and to prevent relative rotation of the receptacle 26 and the rotating post 44 including, for example, by providing particular shapes (e.g., symmetrical polygonal shapes that prevent relative rotation, irregular polygonal or half moon shapes that ensure proper alignment and prevent relative rotation, etc.), and/or configuring different interfaces (e.g., post or nub with corresponding slot or detent, providing the tab on the rotating post 44 and complementary slot in the receptacle 26).

According to an exemplary embodiment, the receptacle 26 includes an aperture 36 configured to receive a fastener 37 to abut a complementary mating surface 56 of the rotating post 44. The aperture 36 and mating surface 56 are disposed opposite the tab 35 and slot 55 of the receptacle 26 and rotating post 44, respectively. The aperture 36 is configured to receive the fastener 37 (e.g., bolt, screw, set screw, etc.), which engages the mating surface 56 to compress the rotating post 44 against an interior surface of the receptacle 26 and press the slot 55 around and/or against the tab 35. Mating surface 56 may be further configured to provide a rigid coupling with the fastener 37 and may, for example, include a detent, lip, or ridge over which the fastener 37 must pass for removal of the rotating post 44 out of the receptacle 26, and/or a tapered surface to localize pressure of the fastener 37 to plastically and/or elastically deform either or both the fastener 37 and mating surface 56 to provide a rigid couple therebetween. The body 23 of the first arm 20 includes an aperture 38 to provide access to the fastener 37, with the aperture 38 being disposed on a bottom side of the first arm 20 so as not to be seen.

According to an exemplary embodiment, the first arm 20 and rotating mounting bracket 40 are configured to limit rotational movement of the first arm 20 relative to the mounting surface. For example, the first arm 20 and the rotating mounting bracket 40 may limit the first arm 20 to rotate approximately 45 degrees counterclockwise from a closed position to an open position (compare FIG. 1A with FIG. 2). The base post 43 of the rotating mounting bracket 40 may, for example, include a channel, ridge, or shelf 57 running between a first stop 58 and a second stop 59. The first arm 20 includes an extension tab 39, for example, extending from the support 32 for the receptacle 26. When the rotating post 44 is disposed in the receptacle 26, the extension tab 39 is disposed in the channel 57. The extension tab 39 may then run between the first stop 58 and the second stop in the channel 57 and, therefore, limit rotation of the first arm 20 to the angular range defined by the first stop 58, second stop 59, and width of the extension tab 39. According to other exemplary embodiments, the rotation of the first arm 20 may be controlled in other manners including, for example providing no limit, allowing more or less rotating, and/or changing the orientation of extension tab 39 and channel 57 (e.g., providing an extension tab on the base post 43 and a channel and/or stops on the first arm 20 or receptacle 26).

According to an exemplary embodiment, the first arm 20 and the rotating mounting bracket 40 are configured such that the first arm 20 covers the rotating mounting bracket 40 from view. The peripheral edge 25 of the base portion 21 and the body 23 of the first arm 20 are sized and shaped to generally cover the rotating mounting bracket 40. Particularly, the peripheral edge 25 may be sized slightly larger than the base flange 42 of the rotating mounting bracket 40 (e.g., larger by 2 mm). The peripheral edge 25 is also shaped according to, and then aligned with, the rotating mounting bracket 40, such that the base flange 42 of the mounting bracket is generally disposed within the peripheral edge 25 of the first arm 20 when the first arm 20 is rotated between open and closed positions. Further, the peripheral edge 25 may be generally planar to be disposed proximate the mounting surface with a generally constant gap between the peripheral edge 25 and the mounting surface. The body 23 is also sized such that the gap is relatively small between the mounting surface and the peripheral edge 25 (e.g., more or less than approximately 2 mm). According to other exemplary embodiments, the first arm 20 and rotating mounting bracket 40 may be configured in other manners, such as having different shapes, providing a larger or smaller gap between the peripheral edge 25 and the mounting surface, allowing a portion of the rotating bracket 40 to be seen in an open position, etc.

Figure 7A:
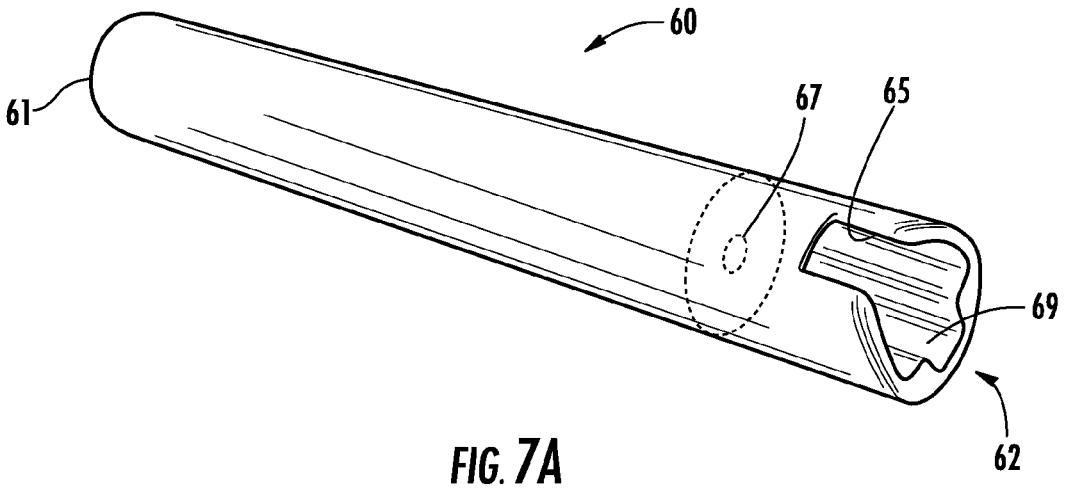
FIG. 7A is a perspective view of an extension member of a paper dispenser according to an exemplary embodiment.
Figure 7B:
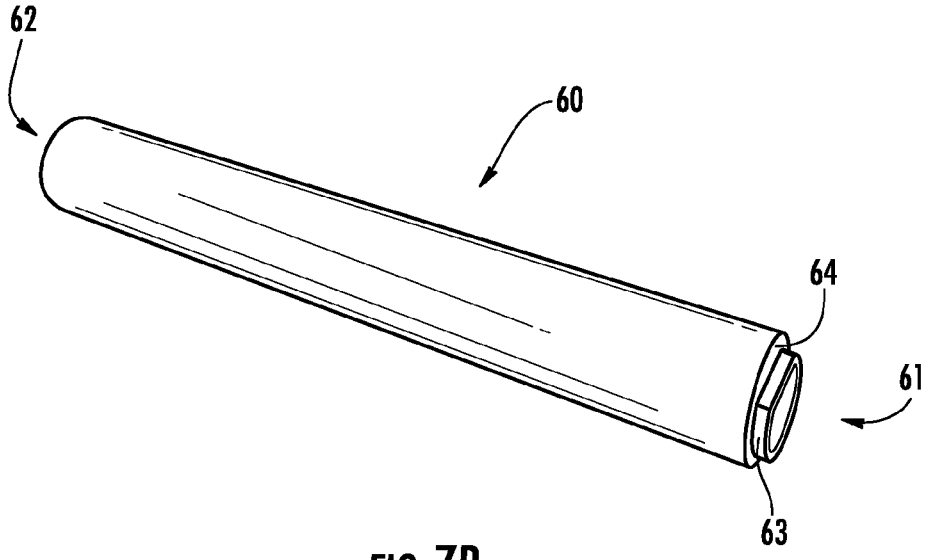
FIG. 7B is a perspective view of the extension member shown in FIG. 7A according to an exemplary embodiment.

Now referring to FIG. 7, the extension member 60 is configured to couple to and extend from the first arm 20 and to releasably engage the second arm 70. The extension member 60 is a generally elongate, hollow member terminating at a first end 61 and a second end 62. The first end is configured to engage the first arm 20 and includes a protrusion 63 and a shoulder 64. The shoulder 64 of the extension member 60 is configured to abut the peripheral edge 28 of the end portion 22 of the first arm 20 (i.e., approximately same outer diameter, thickness, and profile). The protrusion 63 of the extension member 60 is configured to be disposed slightly within the cavity 27 of the end portion 22, so as to maintain alignment of the extension member 60 to the end portion 22 of the first arm 20 (i.e., tight tolerance of less than approximately 0.3 mm). The protrusion 63 may also include a detent that is complementary to an interior profile of the peripheral edge 28, so as to prevent relative rotation between the extension member 60 and the first arm 20. The second end 62 may include an aperture 67 configured to receive and engage the fastener 66, such that the fastener 66 extends through generally the majority of the extension member 60 to couple to the fastening aperture 29 of the first arm 20. According to other exemplary embodiments, the extension member 60 may be integral with the first arm 20 or may be coupled to the first arm 20 in different manners including, for example, disposing the aperture 67 toward the first end 61, press or other interference fit, use of adhesives, etc.

According to an exemplary embodiment, the second end 62 of the extension member 60 is configured to releasably engage a post or extension 85 at an end portion 72 of the second arm 70. The second end 62 generally includes a cutout or mouth 65 and an engaging surface 69. The cutout 65 is configured to have a wider lower portion configured to receive the post 85 of the second arm 70. The engaging surface 69 is configured to releaseably engage (i.e., abut) the post 85, so as to prevent further rotation of the first arm 20 and to prevent translational movement or displacement (e.g., horizontal movement) of the extension member 60 relative to the second arm 70. The engaging surface 69 may be shaped in a complementary manner to the post 85, for example, including an upper rounded surface and generally parallel vertical surfaces extending therefrom, the upper rounded surface having a contour generally matching that of the post 85 and the vertical surfaces being spaced about a distance slightly more than the width of post 85. Further, an interior surface of end 62 of the extension member 60 may be contoured so as to guide the post 85 from the cutout 65 to the engaging surface 69. The second end 62 of the extension member 60 may also be shaped, such as with a tapered or rounded side profile, to account for lateral displacement of a bottom edge of the extension member 60 as it rotates so as not to interfere with the end portion 72 of the second arm 70.

Figure 8A:
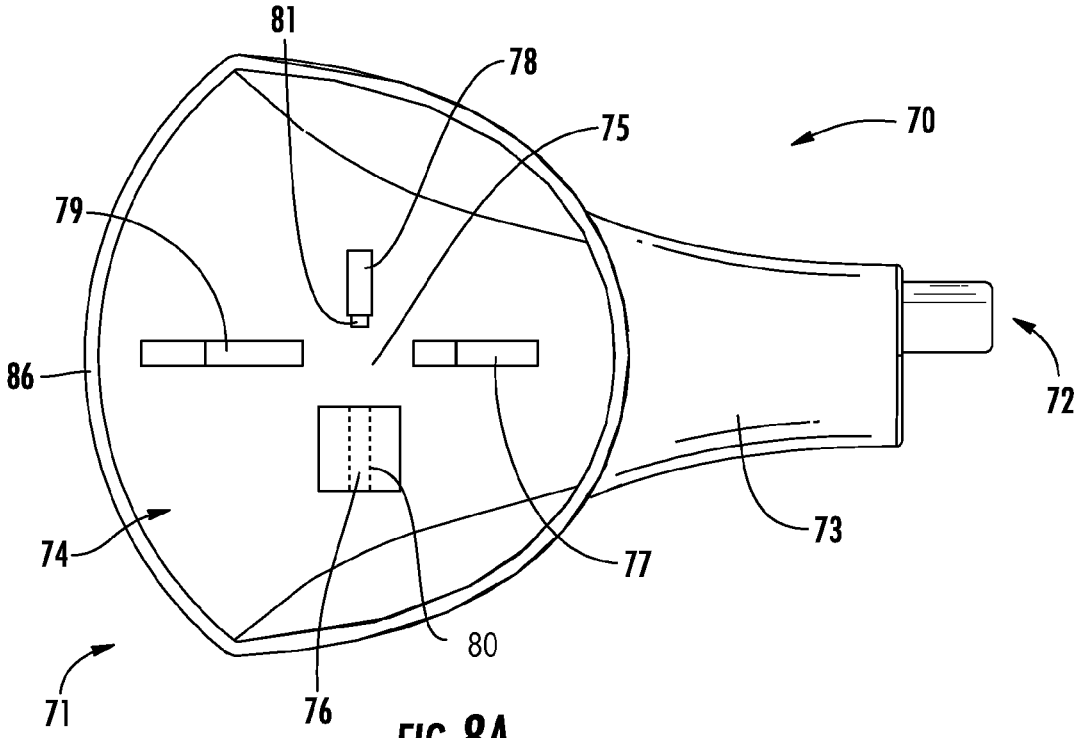
FIG. 8A is a rear view of a second arm of a paper dispenser according to an exemplary embodiment.
Figure 8B:
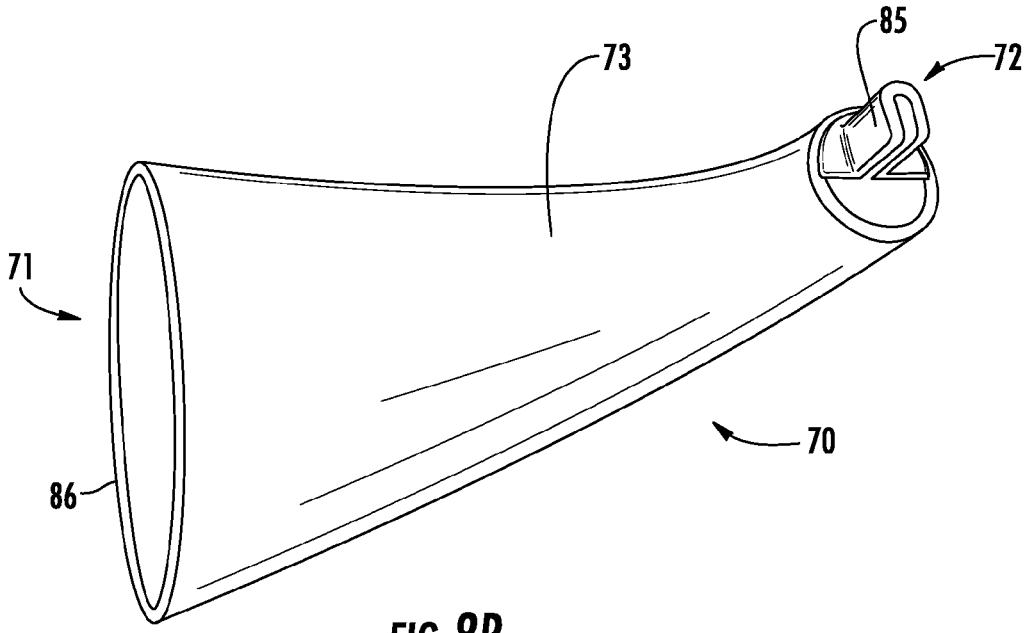
FIG. 8B is a side view of the second arm shown in FIG. 8A according to an exemplary embodiment.

Now referring to FIG. 8A-8B, according to an exemplary embodiment, the second arm 70 generally includes a base portion 71, an end portion 72, and a body 73 extending between the base portion 71 and the end portion 72. The base portion 71 includes a cavity 74 generally defined by a base peripheral edge 86 and an interior surface of the body portion 73. The cavity 74 includes a receptacle 75 integrally or separately formed from the second arm 70. The receptacle 75 is defined by four supports 76, 77, 78, 79, which extend from the interior surface of the cavity 74 to form generally parallel mounting surfaces. As discussed in further detail below, the second arm 70 is configured to rigidly couple to the mounting surface by way of the stationary mounting bracket 90. Various features of the second arm 70 and receptacle 75 are discussed in conjunction with the stationary mounting bracket 90 below.

Referring again to FIG. 3B, according to an exemplary embodiment, the stationary mounting bracket 90 generally includes a mounting flange 91 and a mounting post 92 extending generally perpendicular from the mounting flange 91. The mounting flange 91 includes one or more apertures 93 configured to receive fasteners (e.g., screws, bolts, clips, pins, etc.) to rigidly couple the stationary mounting bracket 90 to the mounting surface.

According to an exemplary embodiment, the stationary mounting bracket 90 is configured to rigidly couple to the second arm 70 so as to mount the second arm 70 to the mounting surface. Similar to the receptacle 26 of the first arm 20 and the rotating post 44 of the rotating mounting bracket 40, the receptacle 75 of the second arm 70 and the mounting post 92 of the stationary mounting bracket 90 include complementary features for a rigid coupling.

According to an exemplary embodiment, supports 76, 78, respectively, provide a tab 81 opposite an aperture 80. The aperture 80 is complementary to a mounting surface 94 of the mounting post 92 of the stationary mounting bracket 90, the aperture 80 configured to receive a fastener 95, such as a set screw. The body 73 of the second arm 70 includes an aperture 88 to provide access to the fastener 95 and is disposed on a bottom side of the second arm 70 so as to be hidden from view. The mounting surface 94 may include a detent and/or a tapered surface, similar to the rotating post 44, configured to receive and rigidly couple to the fastener 95. The tab 81 is complementary to a slot 96 of the mounting post 92. The tab 81 and slot 96 are configured to ensure proper alignment and prevent relative rotation of the second arm 70 and the stationary mounting bracket 70 and may include similar features to the tab 35 and slot 55 of the first arm 20 and rotating post 44, such as relative size, shape, and taper, to rigidly couple the second arm 70 to the stationary mounting bracket 90.

According to an exemplary embodiment, the dispenser 10 is mounted to a mounting surface, such as a wall or other generally planar surface. The rotating and stationary mounting brackets 40, 90 are coupled to the mounting surface, such as with wood screws, bolts, or other fasteners. The brackets 40, 90 disposed at generally the same vertical position and are spaced apart a distance to allow a small gap between the second end 62 of the extension member 60 and the end portion 72 of the second arm 70, while still allowing the second end 62 to engage the post 85. The first arm 20 is then coupled to the rotating mounting bracket 40, the receptacle 26 receiving the rotating post 44 and the fastener 37 turned via a tool extending through aperture 38, such that the fastener 37 rigidly engages the rotating post 44. The second arm 70 is similarly coupled to the stationary mounting bracket 90, the receptacle 75 receiving the mounting post 92 and the fastener 95 turned via a tool extending through aperture 88, such that the fastener 95 rigidly engages the mounting post 92.

According to an exemplary embodiment, after mounting the dispenser 10 to a mounting surface, the dispenser 10 may then be operated. From a closed position, the dispenser 10 may be configured into an open position by applying a generally perpendicular force against the extension member 60 and in parallel with the mounting surface so as to rotate the first arm 20 about the rotating mounting bracket 40. While in the open position, a roll of product may be placed on the extension member 60 and/or an empty roll may be removed from the extension member 60. From the open position, the dispenser 10 may be configured into a closed position by applying a generally perpendicular force against the extension member 60 in parallel with the mounting surface so as to rotate the first arm 20 about the rotating mounting bracket 40 until the extension member 60 engages the post 85 of the second arm 70. Product may then be dispensed by a user pulling on an end of the rolled product so as to unroll and reveal additional product, or by any other manner suitable for removing product from the roll.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

It is important to note that the construction and arrangement of components as shown in the various exemplary embodiments are illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments. Other substitutions, modifications, changes and omissions may also be made in the design, operating conditions and arrangement of the various exemplary embodiments without departing from the scope of the present invention.

What is claimed is:

1. A dispenser for a rolled paper product, comprising:

a first arm comprising a base portion and an end portion, the base portion having a first cavity;

a first mounting bracket disposed in the first cavity, wherein the first mounting bracket is configured to be coupled to a wall;

a bushing assembly comprising:

a first member at least partially disposed in the first cavity; and a second member at least partially disposed in the first cavity;

wherein the first and second members are rotatable relative to one another, such that the end portion and the first member are selectively rotatable relative to the second member and the first mounting bracket, and wherein the first member rotates against a surface of the second member during rotation of the end portion;

a second arm comprising a second cavity;

a second mounting bracket disposed entirely in the second cavity and configured to rigidly couple the second arm to the wall; and an elongated member configured to receive the rolled paper product, the elongated member detachably coupled to the end portion by a fastener extending through the elongated member, such that the elongated member rotates with the end portion relative to the second arm.

2. The dispenser of claim 1, wherein the second arm is configured to cover the second mounting bracket from view when the second mounting bracket is disposed in the second cavity and coupled to the wall.

3. The dispenser of claim 2, wherein the first arm is configured to cover the first mounting bracket from view when the first mounting bracket is disposed in the first cavity of the base portion of the first arm and is coupled to the wall, and wherein the first mounting bracket is disposed entirely in the first cavity of the base portion of the first arm.

4. The dispenser of claim 1, wherein the fastener is coupled to an aperture of the first arm to couple the elongated member to the end portion of the first arm.

5. The dispenser of claim 4, wherein an end portion of the second arm includes an extension, and wherein an end of the elongated member opposite the end of the elongated member coupled to the first arm includes a recess therein that is configured to receive the extension when the elongated member is engaged with the second arm to limit rotation of the elongated member relative to the second arm.

6. The dispenser of claim 5, wherein the fastener is disposed in a longitudinal chamber of the elongated member, and wherein the extension of the end portion of the second arm is a post, and wherein the recess defines an engaging surface of the elongated member that releasably engages an engaging surface of the post.

7. The dispenser of claim 6, wherein the engaging surface of the elongated member is curved, and wherein the recess is further defined by two opposing surfaces extending from opposing ends of the curved engaging surface.

8. The dispenser of claim 7, wherein both the end portion and the base portion of the first arm are selectively rotatable relative to the second arm.

9. The dispenser of claim 1, wherein the end portion and the base portion of the first arm form a unitary member, which is selectively rotatable about the second member and the first mounting bracket relative to the second arm, wherein the first mounting bracket is disposed entirely in the first cavity, and wherein the second mounting bracket disposed entirely in the second cavity.

10. A paper dispenser for a rolled paper product, comprising:

a first arm including an aperture;

a second arm;

an elongated holder assembly coupled to the first arm and configured to retain the rolled paper product, the holder assembly comprising:

a unitary hollow member having a first end, a second end, and a through bore extending from the first end to the second end, wherein at least a portion of the first end is received by a first portion of the aperture and abuts a portion of the first arm; and a fastener disposed in the through bore of the hollow member that engages a second portion of the aperture of the first arm to couple the holder assembly to the first arm;

wherein when the holder assembly is coupled to the first arm, at least a portion of the first arm is configured to rotate the holder assembly relative to the second arm.

11. The paper dispenser of claim 10, further comprising an extension and a notch to limit rotation of the holder assembly relative to the second arm, wherein the second arm includes one of the extension and the notch as a first engaging feature and the holder assembly includes the other of the extension and the notch as a second engaging feature, when the holder assembly is coupled to the first arm, the holder assembly is rotatable relative to the second arm to selectively rotate the first engaging feature into and out of engagement with the second engaging feature.

12. The paper dispenser of claim 10, wherein the second arm includes an extension, the holder assembly includes a notch that is configured to receive the extension, and the first and second ends of the hollow member are integrally formed together.

13. The paper dispenser of claim 11, wherein the extension is a post that is disposed on the second arm, and wherein the notch includes an engaging surface, and wherein the post contacts the engaging surface when releaseably engaged with the notch.

14. The paper dispenser of claim 13, wherein the engaging surface is curved, and wherein the notch further includes two opposing surfaces that extend in diverging manner away from ends of the curved engaging surface, such that an entrance of the notch is wider than the engaging surface.

15. The paper dispenser of claim 11, wherein the notch tapers in a converging manner from an open end toward a closed end, and wherein the open end of the notch is wider than the extension to allow the extension to enter the notch through the open end.

16. The paper dispenser of claim 15, wherein the extension is wider than the closed end of the notch to eliminate a lateral displacement of the holder assembly relative to the second arm.

17. The paper dispenser of claim 11, wherein the extension is tapered, wherein the first arm comprises a base portion and an end portion, wherein the aperture is disposed in the end portion, and wherein both the end portion and the base portion of the first arm are selectively rotatable relative to the second arm.

18. A dispenser for a rolled paper product, comprising:

a first arm assembly comprising a first base portion, a first end portion, a bushing, and a first mounting bracket disposed in a cavity of the first base portion and configured to be fixedly coupled to a wall, wherein the bushing allows selective rotation of the first end portion relative to the first mounting bracket;

a second arm assembly comprising a second base portion, a second end portion, and a second mounting bracket disposed in a cavity of the second base portion and configured to rigidly couple the second arm assembly to the wall; and a holder assembly comprising a first member configured to receive the rolled paper product and a second member disposed within the first member to fixedly couple the first and second members together, wherein a portion of the second member extends beyond an end of the first member to selectively couple the portion of the second member to the first end portion, such that the holder assembly rotates with the first end portion relative to the second arm assembly and to prevent relative movement between the first and the second members;

wherein at least one of the first and second members of the holder assembly includes a recess disposed in an end that is opposite the portion of the second member; and wherein the recess is configured to rotate relative to an extension extending from the second end portion during rotation of the first end portion and the recess is configured to receive the extension in a closed position.

19. The paper dispenser of claim 18, wherein the recess is tapered in a narrowing fashion moving from an external surface of the first member toward an internal engaging surface, and wherein the internal engaging surface is configured to receive the extension of the second end portion to limit rotation of the holder assembly relative to the second end portion.

20. The paper dispenser of claim 19, wherein the second member is disposed in a longitudinal chamber within the first member, wherein the bushing comprises first and second bushing members, and wherein the first bushing member is operatively coupled to at least one of the first base portion and the first end portion, such that the first bushing member rotates with the first end portion relative to the second bushing member, which remains stationary with the first mounting bracket.

21. The paper dispenser of claim 20, wherein the first member of the holder assembly includes the recess, which secures the extension, wherein the second member of the holder assembly is a fastener, wherein the first end portion and the first base portion are coupled together, wherein the first bushing member is coupled to the first base portion, such that the first base portion and the first end portion rotate together relative to the first mounting bracket and the second bushing member, wherein the second mounting bracket is disposed entirely in the cavity of the second base portion, and wherein the first mounting bracket is disposed entirely in the cavity of the first base portion.

* * * * *